US008094007B2

(12) United States Patent
Hinkson et al.

(10) Patent No.: US 8,094,007 B2
(45) Date of Patent: Jan. 10, 2012

(54) ALARM STATUS VOICE ANNUNCIATION USING BROADCAST BAND TRANSMISSIONS

(75) Inventors: Richard H. Hinkson, Plainview, NY (US); Kenneth L. Addy, Massapequa, NY (US); Alfred M. Lizza, Oyster Bay, NY (US)

(73) Assignee: Honeywell International Inc., Morristown, NJ (US)

( * ) Notice: Subject to any disclaimer, the term of this patent is extended or adjusted under 35 U.S.C. 154(b) by 10 days.

(21) Appl. No.: 10/870,858

(22) Filed: Jun. 17, 2004

(65) Prior Publication Data

US 2005/0280529 A1 Dec. 22, 2005

(51) Int. Cl.

| | |
|---|---|
| ***G08B 1/08*** | (2006.01) |
| ***G08B 13/00*** | (2006.01) |
| ***G08B 19/00*** | (2006.01) |

(52) U.S. Cl. ..... 340/539.1; 340/426.15; 340/426.16; 340/521; 340/541; 340/692; 340/12.5

(58) Field of Classification Search ..... 340/521, 340/425.5, 426.15, 539.1, 539.11, 426.13, 340/426.17; 348/156

See application file for complete search history.

(56) References Cited

U.S. PATENT DOCUMENTS

| | | | | |
|---|---|---|---|---|
| 4,141,016 | A * | 2/1979 | Nelson | 343/858 |
| 4,658,237 | A * | 4/1987 | Williamson | 340/426.13 |
| 4,754,255 | A * | 6/1988 | Sanders et al. | 307/10.4 |
| 4,794,368 | A * | 12/1988 | Grossheim et al. | 340/426.25 |
| 4,959,713 | A * | 9/1990 | Morotomi et al. | 348/156 |
| 5,117,217 | A * | 5/1992 | Nykerk | 340/426.23 |
| 5,283,549 | A * | 2/1994 | Mehaffey et al. | 340/521 |
| 5,499,014 | A * | 3/1996 | Greenwaldt | 340/539.11 |
| 5,572,201 | A * | 11/1996 | Graham et al. | 340/902 |
| 5,657,076 | A * | 8/1997 | Tapp | 348/154 |
| 6,452,484 | B1 * | 9/2002 | Drori | 340/426.13 |
| 6,710,715 | B2 * | 3/2004 | Deeds | 340/601 |
| 6,765,486 | B2 * | 7/2004 | Roberts | 340/539.11 |
| 6,804,490 | B2 * | 10/2004 | Cook et al. | 455/3.01 |
| 6,909,357 | B1 * | 6/2005 | Bandy et al. | 340/5.65 |
| 6,980,092 | B2 * | 12/2005 | Turnbull et al. | 340/425.5 |
| 7,068,972 | B2 * | 6/2006 | Tarr | 455/3.06 |
| 2002/0180274 | A1 * | 12/2002 | Suman | 307/10.2 |
| 2003/0020603 | A1 * | 1/2003 | DeLine et al. | 340/425.5 |

OTHER PUBLICATIONS

Data Sheet for Honeywell Ademco 6150V Voice Keypad, 2 pp., printed Apr. 15, 2004 from http://www.ademco.com/ademco/products/keypads/6150v.htm.

(Continued)

*Primary Examiner* — George Bugg
*Assistant Examiner* — Anne Lai
(74) *Attorney, Agent, or Firm* — Husch Blackwell LLP

(57) ABSTRACT

A security system, such as in a home or other building, includes a broadcast band RF transmitter for transmitting an audio message that can be received by a user on a common home or car radio, for example. The audio message may be provided in response to a command that is transmitted to the security system by a user from a wireless key fob or the like. The user command may instruct the security system to arm or disarm itself, for instance. The audio message, which can be received on a selected channel on a car's radio receiver, informs the user that the command has been executed. The audio message may include a voice message such as "system armed" or "system disarmed", a musical passage, a beep, chirp, or the like.

9 Claims, 2 Drawing Sheets

OTHER PUBLICATIONS

Data Sheet for Honeywell Ademco 5804BDV Talking bi-directional remote, 1 p., printed May 10, 2004 from http://www.ademco.com/ademco/products/wireless/5804BDV.htm.

Press release, Mar. 14, 2000, "Ademco Introduces The 5804BDV Bi-Directional Remote Control". 1 p., printed from http://www.ademco.com/press_releases/2000/pr5804bdv.htm.

Data Sheet for PIMA TRU-100DP radio transmitter, 3 pp., printed Apr. 15, 2004 from http://www.pima-alarms.com/code/wichpage.asp?title=Radio%20Transmitters&left=left.

"WeatherHawk is your personal weather station:" 2 pp., printed Jun. 4, 2004 from http://www.weatherhawk.com.

* cited by examiner

ALARM STATUS VOICE ANNUNCIATION USING BROADCAST BAND TRANSMISSIONS

BACKGROUND OF THE INVENTION

1. Field of Invention

The invention relates generally to security systems and, more particularly, to a method and apparatus for providing a voice annunciation of alarm status using a broadcast band transmission.

2. Description of Related Art

Security systems, such as for homes and businesses, have become commonplace as people seek to protect themselves and their property. Home security systems typically employ sensors at entry points, such as windows and doors, along with interior sensors such as motion detectors and glass break detectors. A control panel allows the user to arm and disarm the system, such as by entering a password on a keypad. In addition to sounding a local alarm, the security system may include a telephone dialer for informing a monitoring station of an alarm condition. Moreover, to increase user convenience, security systems are frequently operated by remote control using wireless devices, such as key fob transmitters, that can arm and disarm a security system with the push of a button. The control panel or user interface of the security system may respond to such commands by emitting a beep or spoken message, e.g.,"system armed". However, the user must be near the control panel or user interface to hear the confirmation.

Accordingly, there is a need for a convenient way to provide the user with information regarding the status of a security system when the user is away from the control panel, but is near a broadcast band radio, such as in a vehicle.

BRIEF SUMMARY OF THE INVENTION

The present invention addresses the above and other issues by providing a convenient and easy way for a user to ascertain the status of a security system, in particular, after the user has provided a wireless command to the security system.

The invention can take advantage of existing home or auto entertainment electronics for annunciating the status of a security system. A security system according to the invention may use a low-power broadcast band transmitter to annunciate its status over any common radio, e.g., a home entertainment system's radio, a car radio, or a hand held radio. The user can thus operate the security system in a house, for instance, from a short distance away, such as the driveway of the house. The user sends a wireless signal from a key fob transmitter to arm or disarm the system, while subsequently receiving a status signal via the car radio, for instance, indicating that the command has been executed. The status signal confirms the system operation from a short distance away.

In one aspect of the invention, a security apparatus includes a control for controlling a security system that secures a building, and a transmitter associated with the control for transmitting a broadcast band RF transmission that includes at least one audio message, such as a voice message, regarding a status of the security system. The broadcast band RF transmission may be an FM band transmission having a frequency between about 88 to 108 MHz, or an AM band transmission having a frequency between about 535 to 1605 kHz, for example.

The status of the security system indicated by the audio message may indicate whether the security system is armed or disarmed, or whether an alarm in the security system has been tripped.

A memory may be associated with the control for storing data for providing the audio message.

The security apparatus may further include a receiver associated with the control for receiving a wireless signal from a user including a command for controlling the security system, such as arming or disarming the system. In this case, the transmitter transmits the broadcast band RF transmission responsive to the receiving of the command by the receiver, and the status of the security system indicated by the at least one audio message provides a confirmation to the user that the command has been executed.

A corresponding method is also provided.

BRIEF DESCRIPTION OF THE DRAWINGS

These and other features, benefits and advantages of the present invention will become apparent by reference to the following text and figures, with like reference numbers referring to like structures across the views, wherein.

DETAILED DESCRIPTION OF THE INVENTION

Figure 1:
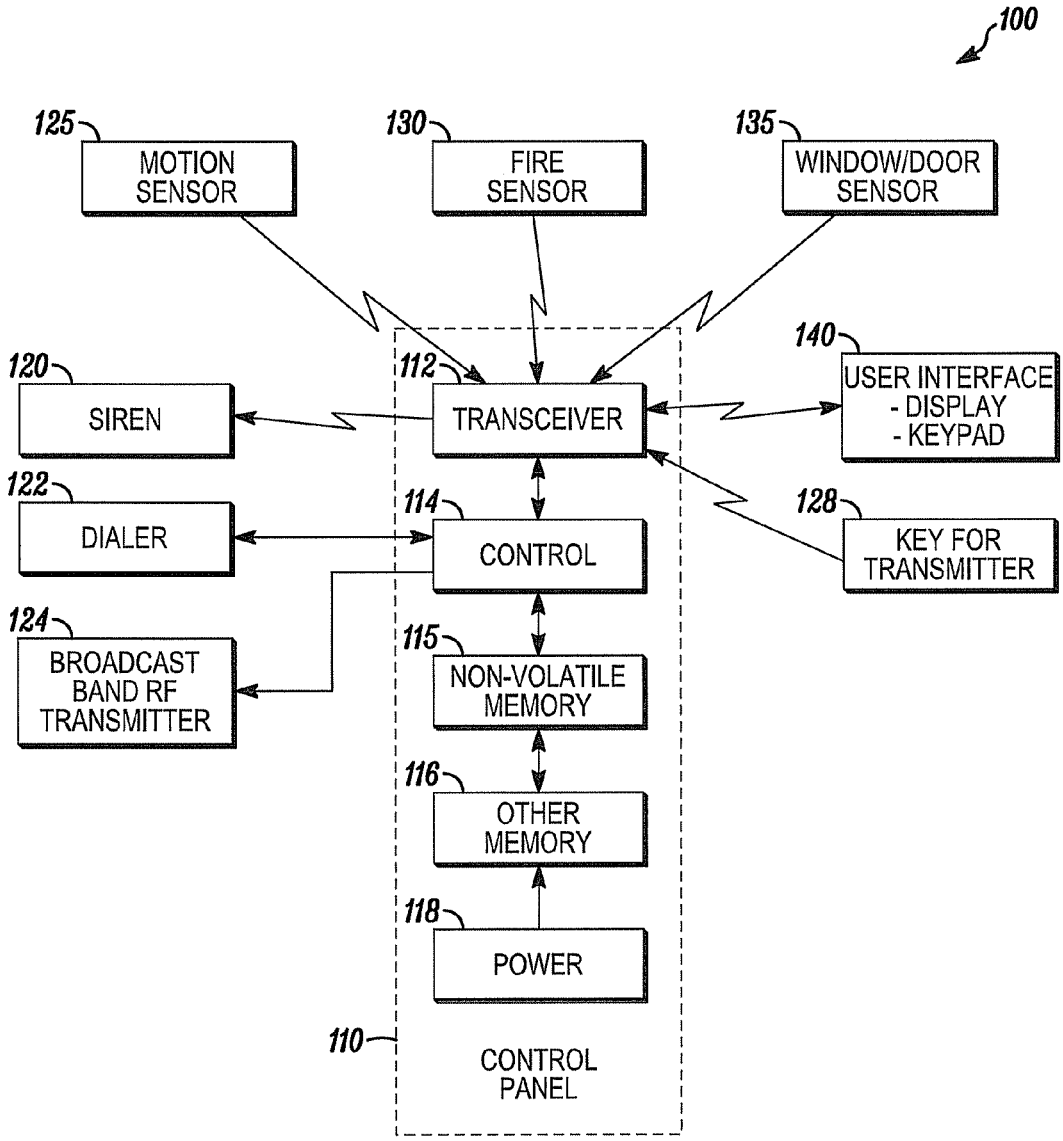
FIG. 1 illustrates an overview of an example security system having a broadcast band RF transmitter, according to the invention.

FIG. 1 illustrates an overview of an example security system, according to the invention. Many buildings such as homes and small businesses today are equipped with security systems to secure the buildings, e.g., by deterring burglaries and detecting fires or noxious fumes such as carbon monoxide. An example security system 100 includes a central control panel 110 that communicates with a number of sensors via a wired or wireless path. For example, the control panel 110 may receive signals from motion sensors 125 that detect when a person enters a room. Signals received from fire sensors 130 indicate that a fire has been detected. Signals received from window and door sensors 135 indicate that a window or door has been opened.

Signals received from a peripheral user interface device 140, such as a keypad and display, a combined display and touch screen, and/or a voice interface, may arm and disarm the system. The user interface device 140 may be the primary interface between the human user and the security system 100 when the user is in the home. The user interface device 140 typically includes components that are analogous to the control panel 110, including a control, memory and power source. Optionally, the user interface device 140 includes a transceiver (transmitter and receiver). The user interface device 140 is commonly provided as a wireless device to allow it to be permanently installed in the home without running wire, such as by affixing it to a wall or placing it on a table, for instance. Moreover, multiple user interface devices may be provided in a home, such as in different rooms. The control panel 110 generally is a larger component that may be installed in an unobtrusive location in the home, such as a closet or basement. However, it is not necessary for the user interface device 140 to be separate from the control panel 110, or to communicate by wireless signals with the control panel 110. For example, the user interface device 140 may be integrated into the control panel 110.

Various other components may communicate with the control panel 110, such as a wireless key fob/panic button transmitter 128 that may be used, e.g., to trip an alarm, arm or disarm the system, or control other functions of the system.

An example wireless key fob is the Honeywell Ademco Model 5804. The control panel 110 may also transmit signals to components of the security system 100. For example, signals may be transmitted to a siren 120 to activate the siren when an alarm condition is detected. Signals may be sent to the user interface device 140 to display status information to the user, such as whether the system is armed or disarmed, whether a specific door or window has been opened, and, when the system is armed, whether an alarm has been tripped. The control panel 110 may also have the ability to notify local emergency services and/or a remote monitoring station of an alarm condition via a telephone dialer 122. Other communication paths such as long-range radio may also be used. The dialer 122 is typically hardwired to the control panel 110 and activated by the control 114.

To facilitate installation and avoid the need to install wiring in a home, wireless security system components may be employed. Some components only transmit or receive. For example, the motion sensors 125, fire sensors 130, and window and door sensors 135 typically only transmit back to the control panel 110 when they are tripped, while the siren 120 only receives a signal from the control panel 110 when the control panel 110 detects an alarm condition based on a signal received from one of the sensors. The wireless key fob 128 may transmit signals to the control panel 110, via the transceiver 112, to send commands to trigger an alarm, or arm or disarm the system, for instance. The user interface device 140 may have both transmit and receive capabilities to communicate with the control panel 110. The wireless security system components may use radio frequency (RF) signals. One common system uses signals at 345 MHz to provide a nominal indoor range of 200 feet and an outdoor range of up to one mile.

The control panel 110 includes a transceiver 112 for transmitting and receiving wireless signals. The control 114 includes a microprocessor that may execute software, firmware, micro-code or the like to implement logic to control the security system 100. The control panel 110 may include a non-volatile memory 115 and other additional memory 116 as required. A memory resource used for storing software or other instructions that are executed by the control 114 to achieve the functionality described herein may be considered a program storage device. A dedicated chip such as an ASIC may also be used. Generally, each wireless component of the security system must be"learned" by the control 114. In the learning process, data is stored in the non-volatile memory 115 that identifies the characteristics of each sensor, including the sensor type, serial number or other code or identifier, and what type of action to take based on signals received from each sensor. For example, the action may be to provide a status message to the user, store data for subsequent maintenance purposes, or trip an alarm. A power source 118 provides power to the control panel 110 and typically includes a battery backup to AC power.

The present inventors have determined that an existing security system can be modified to include a broadcast band RF transmitter 124. The broadcast band RF transmitter 124 may be controlled by the control 114 to transmit an audible message that can be received by a common radio. The broadcast band RF transmitter 124 may be a low-power broadcast band transmitter that transmits an audio message to annunciate a status of the security system over any common radio, e.g., a home entertainment system's radio, a car radio, or a hand held radio. Details for providing a suitable broadcast band RF transmitter are known to those skilled in the art.

The invention thus takes advantage of existing home or auto entertainment electronics. The control 114 may include a capability to provide data to the broadcast band RF transmitter 124 for transmitting an audio message such as a voice message. The control 114 may retrieve the data from the memory 115, for example. The data may include one or more voice messages, such as"system armed" and"system disarmed". The voice messages may be synthesized or may be recorded from live speakers. The data can be stored in any desired format. For example, wav, mp3, aiff, ogg or au formats may be used. Generally, the number and type of messages can be tailored to the capabilities of the wireless key fob transmitter. For example, when the key fob allows control of different zones of a security system, a message such as "zone 1 bypassed" may be provided. A more generic message such as "command received" or "thank you" may also be provided.

Figure 2:
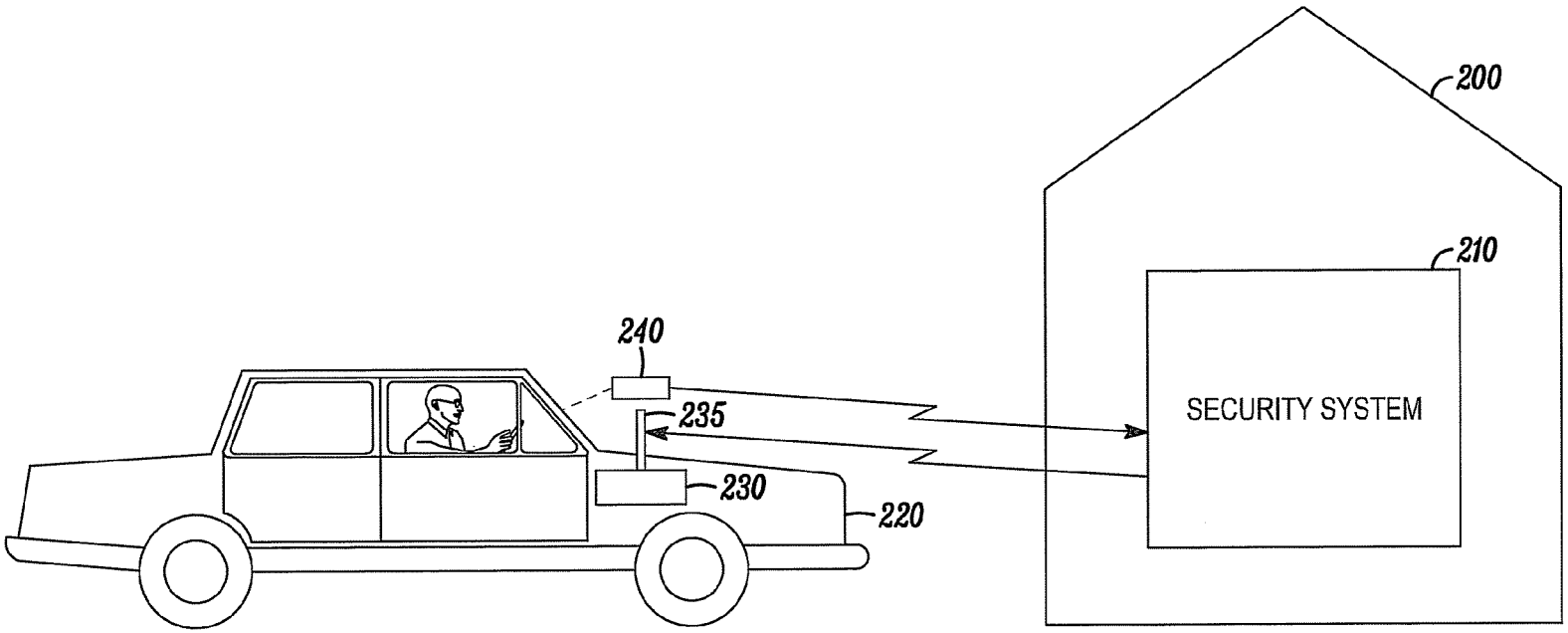
FIG. 2 illustrates an example arrangement wherein a user interacts with a security system having a broadcast band RF transmitter, according to the invention.

FIG. 2 illustrates an example arrangement wherein a user interacts with a security system having a broadcast band RF transmitter, according to the invention. In the example, a security system 210 secures a building such as a house 200. A user in a car 220 activates a wireless key fob 240 or other wireless transmitter to send a command to the security system 210. The car 200 includes a conventional radio receiver 230 with an antenna 235. The user can thus operate the security system 210 from a short distance away, such as the driveway of the house. For example, the user may arm the security system 210 while backing out of the driveway in the car 220, or disarm the system while returning to the home and pulling into the driveway in the car 220. The user need not be in a car, but may be on foot, for instance. Moreover, the user may be in the house 200 itself when transmitting a command to the security system 210.

To arm the security system 210, the user pushes the appropriate button on the wireless key fob transmitter 128 to send a signal to the control panel 110 via the transceiver 112. This transmission is typically at 345 MHz, for instance, which is not within a broadcast band. The transceiver 112 recovers data in the signal and provides the data to the control 114. The control 114 processes and executes the command indicated by the data, e.g., by arming the security system. In response to the command, the control 114 also causes the broadcast band RF transmitter 124 to transmit a broadcast band signal that can be recovered and reproduced by the user's car radio 230 on a specific radio channel. The user is instructed to tune the radio 230 to the specific channel before transmitting the command to the security system. The broadcast band signal includes an audio message such as a voice message that confirms that the security system has been armed. An analogous sequence of events can occur when the user transmits a command to disarm the security system.

Note that the invention allows multiple users to receive a confirmation message at the same time when only one user sends a command to the security system. For example, in a scenario where a family is leaving the home in two cars at the same time, a user in a first car in the driveway may send a command to arm the security system. The confirmation message is received by the users in both cars, thereby avoiding confusion as to whether the security system is armed. The same benefit is provided when multiple cars return to the home.

As an alternative to a voice message, another audio message can be used, such as one or more beeps, chirps or other distinctive sounds that the user recognizes as a confirmation signal from the security system. Moreover, the voice message can be customized to the user's liking. For instance, voice messages recorded by celebrities may be used. Also, the audio message may include a musical passage. Additionally, the data used to generate the messages, e.g., as stored in the memory 115, can be changed by software upgrades to the security system. Such upgrades can be made by a local or remote software download. Thus, new and varied messages can be provided. As a result, the user's enjoyment in using the security system is increased, and the user may be less likely to forget to arm or disarm the system.

Note that the broadcast band audio message can be transmitted by the security system 210 in response to events other than receipt of a command from the user via a wireless key fob. For instance, the broadcast band RF transmitter 124 may periodically or continuously transmit a message warning the user that an alarm in the home's security system has been tripped. When the user drives up to the home and tunes the car's radio to the pre-designated channel, the user can receive a message such as "Warning, alarm has been tripped". The user can then take extra precautions when entering the home. Such a warning message may alternatively be initiated in response to the user sending a signal to disarm the security system while returning to the home. This warning message is in addition to the confirmation message such as "system disarmed".

The broadcast band RF transmitter 124 can transmit in any desired broadcast frequency range. For example, in the U.S, the FCC assigns frequency bands for radio. For example, amplitude modulated (AM) carrier frequencies are in the frequency range 535-1605 kHz. Carrier frequencies of 540 to 1600 kHz are assigned at 10 kHz intervals. The FM radio band is from 88 to 108 MHz. The FM stations are assigned center frequencies at 200 kHz separation starting at 88.1 MHz. Short wave radio bands extend from 5.9 MHz to 26.1 MHz. Citizens band (CB) radio extends from 26.96 MHz to 27.41 MHz. Television stations extend from 54 to 88 MHz for channels 2 through 6, and from 174 to 220 MHz for channels 7 through 13. The invention can use any of these example broadcast bands. The transmitting power should be set to provide the desired range around the secured building while avoiding or minimizing potential interference with neighbor's radios. Moreover, a channel may be selected that is otherwise unused in a given locality in which the secured building is located. One or more antennas can be positioned around the house 200 to provide the desired coverage.

Moreover, note that while a wireless key fob is discussed in the above examples, the invention is meant to be compatible with essentially any type of wireless transmitter that a user may use to control a security system. For example, currently wristwatches are available for controlling a security system by transmitting wireless signals. Moreover, such wireless transmitters need not be carried by the user but may be built into a car, for instance. Such wireless transmitters may also control other electronic components in a home, such as a garage door opener, lights, security gates, appliances, or other relay-activated devices. Also, the wireless transmitter may be activated in any way, including, e.g., voice activation.

The invention has been described herein with reference to particular exemplary embodiments. Certain alterations and modifications may be apparent to those skilled in the art, without departing from the scope of the invention. The exemplary embodiments are meant to be illustrative, not limiting of the scope of the invention, which is defined by the appended claims.

What is claimed is:

1. A security apparatus, comprising:

a control for controlling a security system that secures a building;

a transmitter associated with the control for transmitting a first broadcast band RF transmission that comprises at least one distinctive, non-descriptive audio message regarding an armed status of the security system and a second broadcast band RF transmission that comprises an audio message warning that the alarm has been tripped, the broadcast band RF transmissions being one of an FM band transmission having a frequency between about 88 to 108 MHz, an AM band transmission having a frequency between about 535 to 1605 kHz, a Citizens band (CB) transmission having a frequency between about 26.96 to 27.41 MHz, and a broadcast Television transmission having a frequency between about 54 to 88 MHz, 174 to 220 MHz and 470 to 806 MHz; and a remote device under user control for transmitting a first command to the control and, alternatively, a second command to the control, the first command instructing the control to arm the security system and to transmit the first broadcast band RF transmission and the second command instructing the control to disarm the security system and to transmit the second broadcast message upon detecting that the security system has been tripped.

2. The security apparatus of claim 1, wherein: the at least one audio message comprises a voice message.

3. The security apparatus of claim 1, further comprising: a memory associated with the control for storing data for providing the at least one audio message.

4. The security apparatus of claim 1, further comprising: a receiver associated with the control for receiving a wireless signal from a user comprising a command for controlling the security system; wherein:

the transmitter transmits the broadcast band RF transmission responsive to the receiving of the command by the receiver; and the status of the security system indicated by the at least one audio message provides a confirmation to the user that the command has been executed.

5. The security apparatus of claim 4, wherein: the command received from the user comprises a command for at least one of arming and disarming the security system.

6. A security method, comprising:

controlling by a user from a remote position a security system that secures a building; and responsive to the controlling, transmitting a first broadcast band RF transmission that comprises at least one non-descriptive, distinctive audio message regarding an armed status of the security system and a second broadcast band RF transmission warning that the security system has been tripped, the broadcast band RF transmissions being one of an Fm band transmission having a frequency between about 88 to 108 MHz, an AM band transmission having a frequency between about 535 to 1605 kHz, a Citizens band (CB) transmission having a frequency between about 26.96 to 27.41 MHz, and a broadcast Television transmission having a frequency between about 54 to 88 MHz, 174 to 220 MHz and 470 to 806 MHz, and transmitting occurring in response to receipt of a transmit command by the remote user, the first broadband RF transmission following a transmit command arming the security system and the second broadband RF transmission following a transmit command disarming system and after the security system has been tripped.

7. The security method of claim 6, wherein: the at least one audio message comprises a voice message.

8. The security method of claim 6, further comprising: storing data for providing the at least one audio message.

9. The security method of claim 6, further comprising: receiving a wireless signal from a user comprising a command for controlling the security system; wherein:

the transmitting comprises transmitting the broadcast band RF transmission responsive to the receiving of the command; and the status of the security system indicated by the at least one audio message provides a confirmation to the user that the command has been executed.

* * * * *